United States Patent [19]

Levine et al.

[11] 3,945,541

[45] Mar. 23, 1976

[54] CLOTH FORMING JIGS FOR USE IN THE MANUFACTURE OF CLOTHING

[76] Inventors: Nathan Levine, 1, Ferndale Road, Sefton Park, Liverpool, 15, Lancashire; Eric Leon Levinson, 31, Burnham Road, Allerton, Liverpool, L18 6JU, Lancashire, both of England

[22] Filed: Jan. 21, 1975

[21] Appl. No.: 542,806

[52] U.S. Cl. ..... 223/38

[51] Int. Cl.[2] ..... A41H 33/00

[58] Field of Search ..... 223/1, 38, 37, 2, 52, 52.1; 112/147

[56] References Cited

UNITED STATES PATENTS

| | | | |
|---|---|---|---|
| 2,394,219 | 2/1946 | Vachon | 223/38 X |
| 2,609,129 | 9/1952 | Goldberg | 223/38 |
| 2,858,967 | 11/1958 | Gilbert | 223/38 |
| 2,934,247 | 4/1960 | West | 223/38 |
| 3,093,275 | 6/1963 | Silverman | 223/38 |

*Primary Examiner*—G. V. Larkin

*Attorney, Agent, or Firm*—Ulle C. Linton

[57] ABSTRACT

The invention provides a cloth forming jig for use with a conventional clothing press in the formation of garment parts such as pockets and collars in preparation for their being stitched into position. The jig broadly comprises a base plate formed with a cut-out corresponding in shape to a part to be formed, a forming plate corresponding to said cut-out and pivotal in, and out of, said cut-out, and a forming arm or arms displaceable on said base plate from a position or positions clear of said cut-out to a position or positions overlapping said cut-out.

8 Claims, 3 Drawing Figures

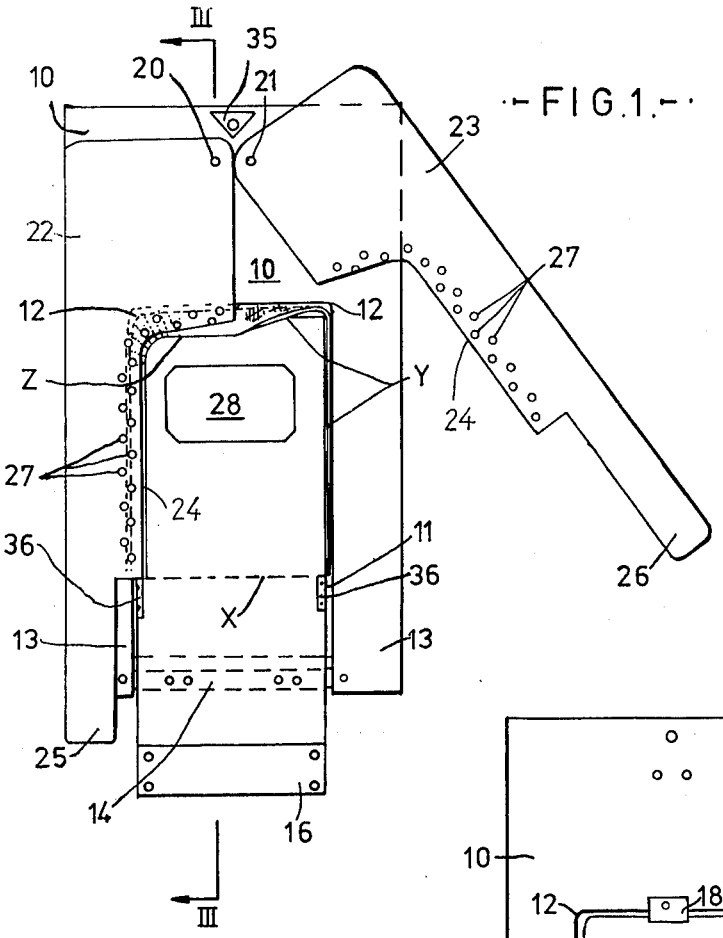
-FIG.1.-
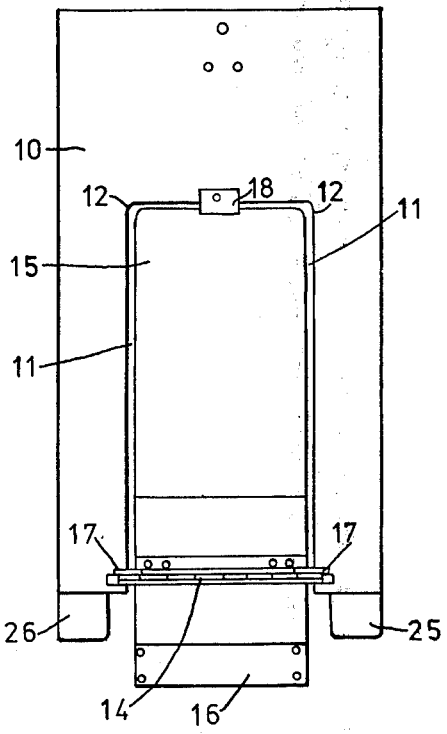
-FIG.2.-

-FIG.3-
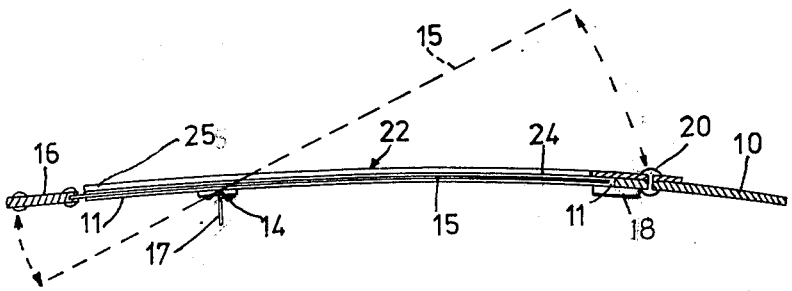

CLOTH FORMING JIGS FOR USE IN THE MANUFACTURE OF CLOTHING

This invention relates to cloth forming jigs for use in formation of garment parts, such for example as pockets, collars and the like (all hereinafter for convenience of reference included in the term 'pocket') wherein it is desirable to provide the piece of material destined to constitute a pocket with a preformed turned over edge, or hem, thereby to greatly facilitate the subsequent stitching of the pocket material in place.

Special purpose machines for achieving this purpose are known, but such machines are costly to install and maintain, utilise dry electric heat in the forming operation, and entail time wasting procedures in changing jigs for each different shape and size of workpiece to be treated.

The present invention has for its object to provide a simple and inexpensive hand operable cloth forming jig arranged for use with any existing clothing press, preferably a steam press, as conventionally found in tailoring establishments.

According to the invention, and in one mode of embodiment, a cloth forming jig broadly comprises a base plate formed with a cut-out of a shape corresponding to the shape and size of a pocket to be formed, a forming plate corresponding in shape and size with said cut-out of the base plate and pivotal from a position clear of said base plate to a position wherein it lies substantially co-planar with said base plate within the cut-out, and a forming arm or arms displaceable on said base plate from a position or positions clear of said cut-out, to a position or positions overlapping said cut-out, i.e. extending beyond the margins of the material defining said cut-out.

Said forming plate may be attached to said base plate by means of a hinge or hinges the axis or axes whereof extend transversely of the lower part of said base plate.

A pair of forming arms may be provided attached one to each side of the upper part of said base plate on pivots the axes whereof are normal to the plane of said base plate. Said forming arms may be formed or provided with handle parts to facilitate their manipulation. The inner peripheral and operative edges of the forming arms may be provided with a plurality of apertures or perforations which facilitate the access of heat or/and steam to the cloth being formed as hereinafter described.

The invention is further described with the aid of the accompanying drawings which illustrate by way of example only two embodiments.

In said drawings:

FIG. 1 is a plan view of a cloth forming jig according to the invention.

FIG. 2 is an underneath plan view, and

FIG. 3 is a section on line III—III of FIG. 1.

Referring to said drawings, the numeral 10 denotes a generally rectangular base plate, which may be composed of any thermally insulating, heat resistant material for example a reinforced plastics material, and which is formed with a cut-out 11 which corresponds in shape and size to a pocket to be formed. In the present case said cut-out 11 is rectangular having rounded corners 12 and is suitable for use in preforming, i.e. folding over three edges, of a piece of material intended to be a patch pocket.

Secured transversely of the lower leg pieces 13, 13 of the base plate 10 is one leaf of a hinge 14, and to the other leaf of said hinge is secured a forming plate 15. Said forming plate 15 corresponds in shape and size with suitable clearance with cut-out 11 and is adapted to be moved from a position in which it lies flush with the base plate 10 within said cut-out 11 as shown most clearly in full lines in FIG. 3, to an open position as indicated in broken lines in said Figure. Said forming plate 15 may be composed of sheet metal provided on its rear end with a heat insulating handle 16. Also secured to the fixed leaf of the hinge 14 is a member 17 of angle section the projecting flange whereof functions as a stop which determines the extent to which the jig is to be inserted in a steam press. Secured to the underside of the base plate 10 is a stop piece 18 which is arranged so as to limit the pivotal movement of the forming plate 15 past a position in which it lies co-planar with said base plate 10.

Pivoted to the upper part of the base plate 10 on axes 20, 21 are two cranked forming arms 22, 23 the inner edges 24 whereof are shaped so as to correspond generally with the shape of the cut-out 11 of the base plate 10. Said arms 22, 23 are pivotal from an open position as illustrated by the arm 23 in FIG. 1, to a closed position as shown by the arm 22. In their closed positions the inner edges 24 of the said arms extend over the clearance space which is provided between the edge of the cut-out 11 and the periphery of the forming plate 15. Said arms 22, 23 are formed with handle portions 25, 26 thereby to facilitate their manipulation in use. The inner margins of said arms 22, 23 are formed with a plurality of apertures 27. A triangular stop 35 may be fitted to the upper part of base plate 10 to limit outward movement of the arms 22, 23, and stops 36 may be provided which limit inward movement of said arms. The stops 36 function as positioning means for material X to be formed.

In use, said arms 22, 23 are pivoted to open position, the forming plate 15 opened to the position shown in dotted lines in FIG. 3, and a piece of material X (FIG. 1) to be treated is positioned uniformly across the cut-out 11 of base plate 10. The forming plate 15 is then closed whereby the margin of the cloth on three sides is upwardly turned as indicated at Y. The arms 22, 23 are then closed whereby the cloth margins are turned fully over so as to lie flatly against and closely conform to the peripheral edges of the forming plate 15 as shown at Z in FIG. 1. The jig is then inserted in a conventional steam press (up to the stop 17) for a short period of time, removed, the jig opened, and the formed workpiece removed from the forming plate 15.

Experiment has shown that a jig in accordance with the present invention is simple to use and effective in operation. Further it has been found to be particularly effective in the forming of workpieces to which a thermally fusible lining is applied and secured in a single forming operation. This provides a more permanent and precise fold due to the lining material being allowed to adopt a smaller radius of curve along the line of fold before the application of heat. The forming plate 15 may be provided on its upper surface with a layer of heat insulating material 28 to facilitate its manipulation.

It is to be understood that, whilst the invention has been herein described more particularly in relation to cloth forming jigs for use with rectangular patch pockets, its scope is not so restricted inasmuch as jigs according to the invention may readily be manufactured for use in the forming of cloth pieces generally as used in the clothing industry.

We claim:

1. A cloth forming jig, comprising a base plate formed with a cut-out, a forming plate corresponding in shape and size with said cut-out and pivotal from a position clear of said base plate to a position wherein it lies substantially co-planar with said base plate within said cut-out, hinge means attaching said forming plate to said base plate, said means having the axis thereof extending transversely of said base plate and a stop being provided on the underside of said base plate arranged to limit pivotal movement of said forming plate, and a pair of forming arms displaceable on said plate from a position clear of said cut-out to a position wherein they extend beyond the margin of said cut-out, and said forming arms being attached one to each side of the upper part of said base plate on pivots the axes whereof are normal to the plane of said base plate.

2. A cloth forming jig, as claimed in claim 1 wherein said arms are provided with handle parts to facilite their manipulation.

3. A cloth forming jig, as claimed in claim 2 wherein said forming arms are provided with a plurality of apertures.

4. A cloth forming jig, as claimed in claim 3, wherein said base plate is composed of a thermally insulating, heat resistant material and said forming plate is composed of metal and provided with a thermally insulating handle.

5. A cloth forming jig, as claimed in claim 4, wherein stops are provided on said base plate to limit the extent of the permitted outward and inward movement of said forming arms.

6. A cloth forming jig, as claimed in claim 5, wherein certain of said stops function as positioning means for cloth to be formed by said jig.

7. A cloth forming jig, as claimed in claim 6, wherein said base plate is provided with a flange on its under surface which determines the extend to which the jig is to be inserted in a steam press.

8. A cloth forming jig, as claimed in claim 7, wherein the upper surface of the forming plate is provided with a layer of thermally insulating material.

* * * * *